United States Patent [19]

Axelrod et al.

[11] Patent Number: 4,631,071

[45] Date of Patent: Dec. 23, 1986

[54] COLD FLOW IMPROVING FUEL ADDITIVE COMPOUND AND FUEL COMPOSITION CONTAINING SAME

[75] Inventors: Joan C. Axelrod, Media, Pa.; Sheldon Chibnik, Cherry Hill, N.J.

[73] Assignee: Mobil Oil Corporation, New York, N.Y.

[21] Appl. No.: 810,115

[22] Filed: Dec. 18, 1985

[51] Int. Cl.[4] ..... C10L 1/22

[52] U.S. Cl. ..... 44/71; 260/404.5

[58] Field of Search ..... 44/71; 260/404.5

[56] References Cited

U.S. PATENT DOCUMENTS

| | | | |
|---|---|---|---|
| 2,606,890 | 8/1952 | Polly et al. | 260/404.5 |
| 3,962,104 | 6/1976 | Swietlik et al. | 252/32.7 E |
| 4,108,613 | 8/1970 | Frost, Jr. | 44/72 |
| 4,283,314 | 8/1981 | Zeilstra | 524/567 |
| 4,297,107 | 10/1981 | Boehmke | 44/71 |
| 4,491,455 | 1/1985 | Ishizaki et al. | 44/62 |
| 4,498,908 | 2/1985 | Chibnik | 44/71 |
| 4,509,954 | 4/1985 | Ishizaki et al. | 44/71 |

*Primary Examiner*—Y. Harris-Smith

*Attorney, Agent, or Firm*—Alexander J. McKillop; Michael G. Gilman; Howard M. Flournoy

[57] ABSTRACT

The product of reaction between an ester derivative of a branched chain monocarboxylic acid, having at least one tertiary amine group, an epoxide and an additional carboxylic acid when added to a hydrocarbyl distillate fuel in minor effective amounts provides a fuel composition having improved cold flowability.

32 Claims, No Drawings

COLD FLOW IMPROVING FUEL ADDITIVE COMPOUND AND FUEL COMPOSITION CONTAINING SAME

BACKGROUND OF THE INVENTION

The present invention is directed to hydrocarbyl fuel compositions having improved low temperature characteristics. More particularly, it is directed to such compositions having a major amount of a suitable distillate fuel and a minor effective amount of an additive compound consisting of the reaction product of an ester derivative of a branched-chain monocarboxylic acid having at least one tertiary-amine group, an epoxide and a carboxylic acid and to said additive compounds.

It is well known that distillate fuels such as diesel fuels are subject to poor flowability at low temperatures and have relatively high cold filter plugging points. Many expedients have been attempted in the prior art to overcome these adverse cold temperature properties.

U.S. Pat. No. 4,108,613 teaches the use of a mixture of (1) the reaction product of an epoxidized alpha-olefin with a nitrogen-containing compound selected from ammonia, an amine, a polyamine or a hydroxyamine and (2) an ethylene-olefin copolymer as an additive to depress the pour point of hydrocarbonaceous fuels and oils.

U.S. Pat. No. 3,962,104 discloses lubricating oil compositions containing minor amounts of quaternary ammonium salts useful as an oil improving additives. The quaternary ammonium salts utilize a cation derived from the reaction product of one molar proportion of a tertiary amine with one or more molar proportions of an olefin oxide and an amount of water in excess of stoichiometric. The anion is derived from an organic acid and the tertiary amine has substitutents which are alkyl, alkenyl, substituted alkyl, substituted alkenyl, aromatic or substituted aromatic groups.

U.S. Pat. No. 4,491,455 describes $C_{12}$–$C_{30}$ linear fatty acid esters of hydroxyamines useful as a means of improving the cold flow characteristics of hydrocarbon fuel oils.

None of these prior art materials utilize the specific branched chain acid reaction products as described below or provide a breakthrough in cold flow plugging point and pour point depression of distillate fuels to ensure the desired performance at low temperatures. Additionally, the materials in accordance with the invention are applicable to a wide variety of distillate (diesel) fuels whereas presently commercially available additive materials are more specific and generally work for only one or two particular fuels, not over a broad range of available fuels.

SUMMARY OF THE INVENTION

Applicants have now discovered novel fuel additive compounds useful in improving the low temperature characteristics of distillate fuel compositions, which compositions comprise a major proportion of a liquid hydrocarbyl distillate fuel and a minor proportion, effective to improve low temperature characteristics such as pour point, cloud point and filterability, of said additive compounds consisting of the reaction product of (1) an ester derivative of a branched chain monocarboxylic acid having at least one tertiary amine group, (2) an epoxide and (3) additional carboxylic acid and to said compositions and to a method of reducing the pour point, cloud point and the LTFT thereof.

DETAILED DESCRIPTION

The present invention is directed to improved low temperature distillate fuel compositions comprising said fuel and the described additive product or compound which, when added to the distillate fuel in cold flowability effective amounts, significantly decreases LTFT as well as the pour point, cloud point of the fuel to which it is added. Suitable fuels include, but are not limited to, diesel fuel, home heating oil, airplane jet fuel and the like.

The additive providing these properties is a product of reaction formed by (1) the reaction of an ester derivative of a branched chain monocarboxylic acid having at least one t-amine group, (2) an epoxide and (3) an additional carboxylic acid. The invention is therefore directed also to the additive products of reaction themselves. The additional carboxylic acid may be the same branched chain carboxylic acid or a different branched chain acid or a linear carboxylic acid. When added to a hydrocarbyl distillate fuel, these additive products significantly decrease the fuel's pour point and cloud point as well as its cold flow plugging point below the temperatures obtained by additives utilized in the prior art. The additive product of reaction in accordance with the present invention is therefore the reaction product of a branched chain monocarboxylic acid amide which contains a tertiary amine, an epoxide and a carboxylic acid.

The preferred branched chain carboxylic acids are telomer acids which may be prepared by any method known in the art. One such method is the free radical addition of one mole of acetic anhydride or acid to at least 3 moles of hexene and/or a higher olefin having up to about 30 or more carbon atoms ($C_{30}^{+}$) in the presence of a trivalent manganese compound. This invention is not, however, limited to any specific method of preparing the telomer acids. Any method known in the art may be used. Preferred telomer acids are those made from $C_{10}$–$C_{20}$ alpha olefins and manufactured under the trade name Kortacid through Akzo Chemie, Chicago, Ill. Specific acids are identified for example as Kortacid T-1801, Kortacid T-1001 and the like. The first two digits give the number of carbon atoms in at least one side chain of the acid. More specifically it is noted that the monocarboxylic acid having the below structural formula is known and further identified as a telomer acid and may be formulated in accordance with a procedure provided in U.S. Pat. No. 4,283,314 in which a compound having the same structural formula and meanings is disclosed. U.S. Pat. No. 4,283,314 is incorporated herein by reference.

Independent of the molecular weight, it is particularly preferred that the branched chain monocarboxylic acid have the structural formula

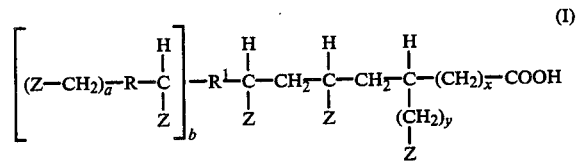

(I)

where Z is $-(CH_2)_nCH_3$ where n is an integer of from about 3 to about 42; x and y are different and are either 0 or 2; a is 0 or 1, if a is 0, R is hydrogen but if a is 1, R is —$CH_2$and b is 0 or 1, if b is 0, $R^1$ is hydrogen but if b is 1, $R^1$ is —$CH_2$.

The epoxides useful herein generally contain from 2 to about 18 carbon atoms. The epoxides may be substituted with an aromatic or a saturated or unsaturated aliphatic group. Among the preferred epoxides that may be used in the present invention are ethylene oxide, propylene oxide, styrene oxide, 1,2-epoxybutane, decene epoxide, tetradecene epoxide and octadecene epoxide and the like. It is emphasized that the above list is non-limiting. Any other epoxides, within the preferred group of epoxides having 2 to 18 carbon atoms may be advantageously used.

The ester derivatives may be formed by a simple reaction between the branched chain monocarboxylic acid (preferably telomer) and a suitable hydroxy amine such as $$RCO_2H + HO\text{-}CH_2CH_2CH_2N(CH_3)_2 \rightarrow RCO\text{—}O\text{—}CH_2CH_2CH_2N(CH_3)_2$$

where R is a telomer acid radical. Any suitable amino alcohol or hydroxy compound may be used and any conventional process known to the art may be used to provide the ester derivative. The ester derivative is thereafter reacted with an epoxide and additional carboxylic acid.

The ester derivative reaction product may be classified by the generic formula $$R^2COO(R^3)N(R^4)(R^5) \qquad \text{(II)}$$

where $R^2$ is a branched chain monocarboxylic acid radical having a molecular weight of between about 300 and 1,000; $R^3$ is hydrogen or $C_1$–$C_{25}$ alkyl; and $R^4$ and $R^5$ are the same or different and are $C_1$–$C_{25}$ alkyl or substituted alkyl. The above derivative is further defined by the branched chain hydrocarbyl $R^2$ having a molecular weight of between about 300 and 1,000. $R^2$, in a preferred embodiment, has the generalized structural formula

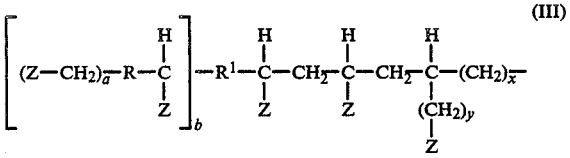

(III)

where Z, R, $R^1$, n, a, b, x and y have the meanings given for structure (I).

Structural formula II is limited to those derivatives having only one ester group and only one tertiary amine group. However, the invention is also directed to derivatives having more than one (multiple) ester groups and more than one (multiple) tertiary amine groups. An example is:

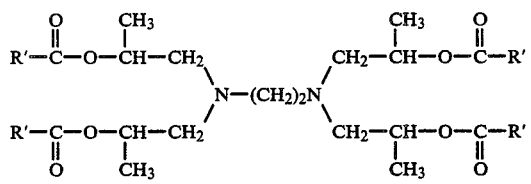

with 4 ester groups and 2 tertiary amine groups where at least one R′ is a telomer acid radical and the remaining R′ groups may be the same or different or may be linear or branched and are from $C_1$ to about $C_{25}$ hydrocarbyl or hydrogen.

Generally speaking, the branched chain monocarboxylic acid having a molecular weight of about 300 to 1,000 may be reacted as disclosed above with a suitable hydroxy amine or amino alcohol to produce the described ester derivative. In a more preferred embodiment of the present invention, the branched chain monocarboxylic acid has a molecular weight of 400 to 900. Still more preferably, the molecular weight of the branched chain monocarboxylic acid is in the range of between 500 and 800.

Some of the useful amines include but are not limited to N,N′N′-tris-(2-hydroxypropyl)N-tallowalkyl-1,3-diaminopropane, N,N,N′,N′-tetrakis(2-hydroxypropyl-)ethylenediamine, N,N,N′,N′-tetrakis(2-hydroxymethyl)ethylenediamine, 3-dimethylaminopropanol, N-methyldiethanolamine and the like and mixtures of two or more of these. Especially preferred is N,N,N′,N′ tetrakis(2-hydroxypropyl)ethylenediamine. All the R groups mentioned are alkyl, nevertheless, other useful groups can be alkenyl, aryl, alkaryl, aralkyl or cycloalkyl. If aryl, the group will contain 6 to 14 carbon atoms. The amines may be obtained as articles of commerce or prepared in any convenient manner.

The product of reaction of (1) an ester derivative of a telomer acid (2) an epoxide and (3) additional carboxylic acid has been surprisingly found to improve the cold temperature performance of distillate fuels such as diesel fuels, residential fuel oils, aviation jet fuels and the like. This improved performance is manifested by significantly decreased pour point, cloud point, cold flow plugging point and LTFT temperatures of fuels to which additives/compounds of the present invention are added.

The various reactants are usually reacted in substantially stoichiometric amounts of equimolar amounts, however, a slight molar excess of telomer acid to other reactants may be used if desired at temperatures ranging from about 50°–175° C. at pressures determined by the specific reaction, i.e., autogenous in 0.5 to about 3 hours or more. As noted hereinabove, it is to be understood that when the amine derivative is reacted with the epoxide and additional carboxylic acid, said additional carboxylic acid may also be a branched chain acid which may be a telomer acid that is different or the same as the acid from which the amide derivative is prepared or a linear monocarboxylic acid. The additional carboxylic acid has up to 25 or more carbon atoms, preferably 10–25.

The improved cold flow effect manifested by the additives of the present invention to distillate fuels is accomplished by providing an effective cold flow improving amount of the additive compound of the present invention to a distillate fuel. More preferably, the amount added to the distillate fuel is in the range of between about 0.01 and 3–5 percent by weight, based on the total weight of the fuel composition. Still more preferably, the concentration of the flow improving product of reaction of the present invention to the distillate fuel is in the range of between 0.02 and 2 percent by weight. In certain cases, depending, inter alia, on the particular fuel and/or weather conditions, up to about 10 wt.% may be used. Up to about 10–20 wt.% of other additives for their known purposes may also be used.

The following examples are given to illustrate the present invention. Since these examples are given for illustrative purposes only, the invention embodied therein should not be limited thereto.

BASE A

A tetraester of telomer acids was prepared from 66 g Kortacid (Trade name) T-1801 (Akzo Chemie, Chicago, Ill., and 5.7 g Quadrol (BASF Wyandotte: N,N,N',N'-tetrakis [2-hydroxypropyl]ethylenediamine) at 175° C. with azeotropic removal of water. The material had an acid value of 10.1.

BASE B

A triester of telomer acids and Propoduomeen T/13 (Armak: N,N',N'-(2-hydroxypropyl)-N-tallowalkyl-1,3-diaminopropane) was prepared in a similar manner from 168.2 g Kortacid T-1801 and 36.3 g of the aminoalcohol.

BASE C

A monoester of the telomer acids was prepared from 174.5 g Kortacid T-1801 and 37.6 g DMAMP (Angus Chemical: an 80% aqueous solution of 3-dimethylaminopropanol) using toluene for azeotropic removal of water at 150° C.

BASE D

A diester was prepared from 188.5 g Kortacid T-1801 and 16.5 N-methyldiethanolamine under similar conditions.

BASE E

A diester of Kortacid T-1801 and Texaco M-302 was prepared in a similar manner. Texaco M-302 is described as having the approximate composition:

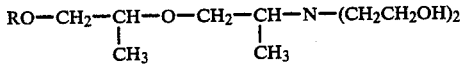

$R = C_{10-12}$

EXAMPLES 1-5

Preparation of the epoxidized additives was as follows:

Equimolar amounts of the base (A through E), an epoxide as indicated in Table 2, and Kortacid (Tradename) T-1801 were heated at 80°-125° C. until no free epoxide was noted by infrared analysis. For volatile epoxides, a sealed pressure vessel was used but in other cases simple stirring in an open flask was sufficient. The reaction was usually complete within two hours at 125° C.; but it was often convenient to keep the propylene oxide pressure bottle reactions on a steam bath overnight. Where more than one tertiary amine group was present (Examples 1 and 2) equivalent amounts of epoxide and acid could be used for each amine. The additives were used as recovered from the reaction flask without further purification or workup.

EVALUATION

The materials described in Examples 1 to 5 were blended (0.1 percent by weight) into a typical diesel fuel (Table 1) and tested for pour point (ASTM D-97), cloud point (ASTM D-2500) and filterability by the LTFT procedure described below with the results shown in Table 2. The mole ratio of tertiary amine/epoxide/acid is 1/1/1 except as otherwise noted. LTFT testing starts at −6° F. A failure at this point indicates essentially no significant reduction from the control base oil test at 1°.

LTFT, Low Temperature Flow Test for Diesel Fuels, a filtration test under consideration by CRC (Coordination Research Council). LTFT Procedure: The test sample (200 ml) is gradually lowered to the desired testing temperature at a controlled cooling rate. After reaching that temperature the sample is removed from its cold box and filtered under vacuum through a 17 micrometer screen. If the entire sample can be filtered in less than 60 seconds it shall be considered as having passed the test. An F in this test indicates failure at the maximum acceptable temperature (−6° F.). All test results are shown in the Table.

Any suitable distillate fuel oil or diesel fuel oil may be used in accordance herewith. However, as mentioned hereinabove, fuels having an initial boiling point of about 350° F. and an end point of about 675° F. are preferred. The base diesel fuel used in these tests was a blend of 15% kerosene with 85% of a straight distillate having the following characteristics:

TABLE 1

| Typical Diesel Fuel: | Distillation | °F. |
|---|---|---|
| | Initial | 366 |
| | 50% | 487 |
| | End | 663 |
| Viscosity at 40° C. | | 2.185 cst |
| API Gravity | | 34.8 |
| Sulfur | | 0.17% |
| Aniline Point | | 130° F. |

TABLE 2

| BASE | EPOXIDE | LTFT, °F. | POUR POINT, °F. | CLOUD POINT, °F. |
|---|---|---|---|---|
| Unmodified Fuel (No Additive) | | 1 | −10 | 6 |
| A | Propylene | −8 | −40 | 0 |
| B | Propylene, 1/1/1 | −6 | −45 | 0 |
| B | Propylene, 1/2/2 | −8 | −45 | — |
| B | Dodecene | −8 | −45 | −1 |
| C | Propylene | −8 | −35 | — |
| D | Propylene | −6 | −40 | — |
| E | Tetradecene | −6 | −40 | 0 |

The data of Table 2 clearly show the improved results obtained over the unmodified when additive compositions in accordance with the invention are used.

The important data is that with respect to the low Temperature Flow Test. It is noted that the additives of the invention dramatically improved the low temperature characteristics of the base fuel oil.

Although the present invention has been described with preferred embodiments, it is to be understood that modifications and variations may be resorted to, without departing from the spirit and scope of this invention, as those skilled in the art will readily understand. Such modifications and variations are considered to be within the purview and scope of the appended claims.

What is claimed is:

1. A product of reaction useful for improving the low temperature characteristics of hydrocarbyl distillate fuels produced from the reaction of (1) a branched chain monocarboxylic acid ester having at least one tertiary amine group and at least one branched chain acid ester group, (2) an epoxide having from 2 to about 18 carbon atoms and (3) additional carboxylic acid selected from branched chain monocarboxylic acids and linear monocarboxylic acids and wherein said reactants are reacted in substantially stoichiometric or equimolar amounts at temperatures ranging from about 50° to about 175° C. under autogenous pressure in 0.5 to about 3 hours or more.

2. The reaction product of claim 1 wherein said ester has the following generalized structural formula:

$$R^2COO(R^3)N(R^4)(R^5)$$

where $R^2$ is a branched chain monocarboxylic acid radical having a molecular weight of from about 300 to about 1,000, $R^3$ is hydrogen or $C_1$ to about $C_{10}$ alkyl, $R^4$ and $R^5$ are the same or different and are $C_1$ to about $C_{25}$ alkyl or substituted alkyl and said branched chain monocarboxylic acid radical $R^2$ is a telomer acid radical.

3. The reaction product of claim 1 wherein said ester has the following generalized structural formula:

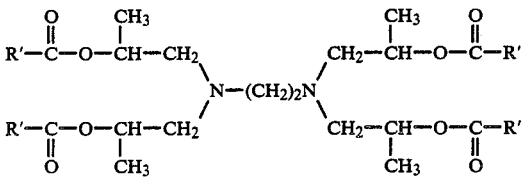

where at least one R′ is a telomer acid radical and the remaining R′ groups are the same or different, linear or branched and from $C_1$ to about $C_{25}$ hydrocarbyl or hydrogen.

4. The reaction product in accordance with claim 2 wherein at least a portion of said telomer acid radical has the following generalized structure:

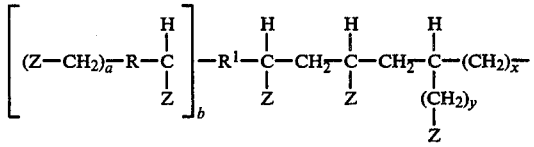

where Z is $-(CH_2)_nCH_3$; n is an integer of from 3 to 42; x and y are different and are 0 or 2; a is 0 or 1; if a is 0, R is hydrogen but if a is 1, R is $-CH_2$; and b is 0 or 1; if b is 0, $R^1$ is hydrogen but if b is 1, $R^1$ is $-CH_2$.

5. The reaction product in accordance with claim 3 wherein at least a portion of said telomer acid radical has the following generalized structure:

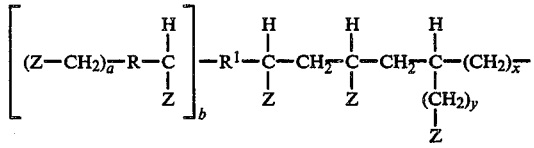

where Z is $-(CH_2)_nCH_3$; n is an integer of from 3 to 42; x and y are different and are 0 or 2; a is 0 or 1; if a is 0, R is hydrogen but if a is 1, R is $-CH_2$; and b is 0 or 1; if b is 0, $R^1$ is hydrogen but if b is 1, $R^1$ is $-CH_2$.

6. The reaction product in accordance with claim 1 wherein said additional carboxylic acid is a telomer acid and said branched chain monocarboxylic acid ester is derived from the same telomer acid.

7. The reaction product in accordance with claim 1 wherein said additional carboxylic acid is a telomer acid and said branched chain monocarboxylic acid ester is derived from a different telomer acid.

8. An additive product useful for improving the low temperature characteristics of hydrocarbyl distillate fuels comprising the reaction product of (1) a branched chain monocarboxylic acid ester having the following generalized structure $$R^2COO(R^3)R^4N(R^5)(R^6)$$

where $R^2$ is a branched chain monocarboxylic telomer acid radical having a molecular weight of from about 300 to about 1,000, $R^3$ is hydrogen or $C_1$–$C_{10}$ alkyl, $R^4$ and $R_5$ are the same or different and are $C_1$–$C_{25}$ alkyl or substituted alkyl; (2) an epoxide containing 2 to 18 carbon atoms with (3) a carboxylic acid and wherein at least a portion of said branched chain acid radical has the following generalized structural formula

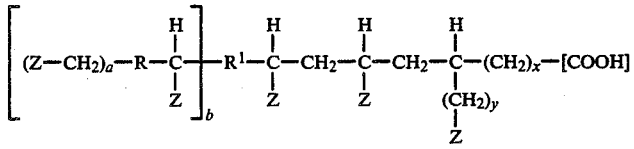

where Z is $-(CH_2)_nCH_3$; n is an integer of from 3 to 42; x and y are different and are 0 or 2; a is 0 or 1; if a is 0, R is hydrogen but if a is 1, R is $-CH_2$; and b is 0 or 1; if b is 0, $R^1$ is hydrogen if b is 1, $R^1$ is $-CH_2$, said reactants being reacted in substantially stoichiometric or equimolar amounts at temperatures ranging from about 50° to about 175° C. under autogenous pressure in 0.5 to about 3 hours or more and wherein said carboxylic acid is selected from branched chain monocarboxylic acids and linear monocarboxylic acids.

9. The additive product of claim 8 wherein said ester has the following generalized structural formula:

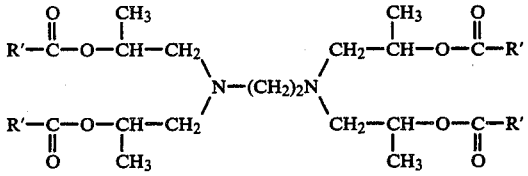

where at least one R′ is a telomer acid radical and the remaining R′ groups are the same or different, linear or branched and from $C_1$ to about $C_{25}$ hydrocarbyl or hydrogen.

10. The additive product of claim 8 wherein said telomer is further identified as a $C_{18}$ telomer acid.

11. The additive product of claim 8 wherein said telomer acid is further identified as a $C_{10}$ telomer acid.

12. The additive product of claim 8 wherein said telomer acid is further identified as a $C_{14}$ telomer acid.

13. The additive product of claim 8 wherein said telomer acid is further identified as a $C_{20}$ telomer acid.

14. The additive product in accordance with claim 8 wherein said branched chain acid has at least one side chain of from about 8 to 18 carbon atoms.

15. The additive reaction product in accordance with claim 14 wherein said branched chain acid has at least one side chain having about 18 carbon atoms.

16. The reaction product of claim 1 wherein the epoxide reactant is selected from the group consisting essentially of propylene oxide, dodecene oxide, and tetradecene oxide.

17. The reaction product of claim 1 wherein the ester derivative is derived from an amine selected from the group comprising the following amines N,N'N'-tris(2-hydroxypropyl)N-tallowalkyl-1,3-diaminopropane, N,N,N,',N'-tetrakis(2-hydroxypropyl)ethylenediamine, N,N,N',N'-tetrakis(2-hydroxyethyl)ethylenediamine, 3-dimethylaminopropanol, N-methyldiethanolamine and the like and mixtures of two or more of these.

18. The reaction product of claim 17 wherein said product is further identified as a tetraester of a $C_{18}$ telomer acid, N,N,N',N'-tetrakis(2-hydroxypropyl)ethylenediamine, propylene oxide and additional $C_{18}$ telomer acid.

19. The reaction product of claim 17 wherein said product is further identified as a tetraester of a $C_{14}$ telomer acid, N,N,N',N'-tetrakis(2-hydroxypropyl)ethylenediamine, propylene oxide and additional $C_{14}$ telomer acid.

20. The reaction product of claim 17 wherein said product is further identified as a tetraester of a $C_{20}$ telomer acid, N,N,N',N'-tetrakis(2-hydroxypropyl)ethylenediamine, propylene oxide and additional $C_{20}$ telomer acid.

21. The reaction product of claim 17 wherein the molar ratio of amine/epoxide/additional acid is 1/1/1.

22. The reaction product of claim 17 wherein the molar ratio of amine/epoxide/additional acid is 1/2/2.

23. The reaction product of claim 17 wherein the epoxide is decane oxide.

24. The reaction product of claim 17 wherein the expoxide is tetradecane oxide.

25. A distillate fuel composition comprising a major proportion of a hydrocarbyl distillate fuel and a minor cold flow improving amount of the additive reaction product defined in claim 1 effective to reduce the pour point, cloud point and the Low Temperature Flow Test of said fuel.

26. A distillate fuel composition comprising a major amount of a hydrocarbyl distillate fuel and a minor cold flow improving amount of the additive of claim 4.

27. A distillate fuel composition comprising a major proportion of a hydrocarbyl distillate fuel and a minor cold flow improving amount of the additive of claim 8.

28. A hydrocarbyl distillate fuel composition comprising a distillate fuel and between about 0.01 and 3% by weight, based on the total weight of the composition, of the additive of claim 1.

29. A hydrocarbyl distillate fuel composition comprising a distillate fuel and between about 0.01 and 3–5% by weight, based on the total weight of the composition, of the additive of claim 8.

30. A method for lowering the pour point, cloud point and the Low Temperature Flow Test point of hydrocarbyl distillate fuels which comprises adding a minor pour point depressant and LTFT lowering amount of a product of reaction as defined in claim 1.

31. A method for lowering the pour point, cloud point and the Low Temperature Flow Test of hydrocarbyl distillate fuels which comprises adding a minor pour point depressant and LTFT lowering amount of a product of reaction as defined in claim 4.

32. A method for lowering the pour point, cloud point and the Low Temperature Flow Test of hydrocarbyl distillate fuels which comprises adding a minor pour point depressant and LTFT lowering amount of a product of reaction as defined in claim 8.

* * * * *